US005597152A

United States Patent [19]

Chinzei

[11] Patent Number: 5,597,152

[45] Date of Patent: Jan. 28, 1997

[54] PAPER ACCUMULATOR UNIT

[75] Inventor: Kiyoshi Chinzei, Hyogo, Japan

[73] Assignee: Fujitsu Limited, Kawasaki, Japan

[21] Appl. No.: 499,577

[22] Filed: Jul. 7, 1995

[30] Foreign Application Priority Data

Jul. 11, 1994 [JP] Japan ..... 6-158482

[51] Int. Cl.[6] ..... B65H 43/04; B31B 1/26

[52] U.S. Cl. ..... 270/39.05; 270/58.28; 271/215; 414/926; 493/412

[58] Field of Search ..... 270/58.13, 58.28, 270/39.05; 271/214, 215, 217; 414/924, 926, 796.7; 493/411, 412, 413

[56] References Cited

U.S. PATENT DOCUMENTS

| | | | |
|---|---|---|---|
| 3,178,172 | 4/1965 | Lettan | 493/411 |
| 3,625,377 | 12/1971 | Bohannon et al. | 414/796.7 |
| 4,046,371 | 9/1977 | Sevak | 271/214 X |
| 4,189,133 | 2/1980 | Arrasmith et al. | 271/217 X |
| 4,229,650 | 10/1980 | Takahashi et al. | 271/215 X |
| 4,927,131 | 5/1990 | Hashimoto et al. | 271/217 X |
| 5,008,716 | 4/1991 | Onose et al. | 270/39.05 X |
| 5,098,074 | 5/1992 | Mandel et al. | 270/58.13 |
| 5,201,509 | 4/1993 | Kirchhoff et al. | 414/924 X |

FOREIGN PATENT DOCUMENTS

| | | | |
|---|---|---|---|
| 55-44421 | 3/1980 | Japan | 493/411 |
| 56-56457 | 5/1981 | Japan | 271/217 |

*Primary Examiner*—John E. Ryznic

*Attorney, Agent, or Firm*—Armstrong, Westerman, Hattori, McLeland & Naughton

[57] ABSTRACT

A paper accumulator unit comprising a table which can be lifted and lowered, being kept in a horizontal condition and on which paper which has been discharged from above is continuously stacked and stored, a stepping motor for lifting and lowering the table with the driving torque of its rotary shaft, and an electromagnetic brake coupled to the rotary shaft of the stepping motor, which brakes the rotation of the rotary shaft when the brake is in a deenergized state.

15 Claims, 10 Drawing Sheets

PR1
PR2
PR3
0
HIGH SPEED
0
Max
0
ON
OFF
ON
OFF
RELEASED
OPERATED
t1
ENERGIZING CURRENT
PULSE RATE
ROTATIONAL SPEED
TORQUE
ENERGIZING CURRENT
BRAKE
UPPER LIMIT POSITION P4
INTERMEDIATE POSITION P3
INTERMEDIATE POSITION P2
LOWER LIMIT POSITION P1
STEPPING MOTOR 45
TABLE LIFTING SWITCH
DEENERGIZATION-TYPE ELECTROMAGNETIC BRAKE 46
POSITION OF TABLE 32
PHOTOSENSOR 61

PAPER ACCUMULATOR UNIT

BACKGROUND OF THE INVENTION (1) Field of the Invention

The present invention relates to a paper accumulator unit, and more particularly to a paper accumulator unit for use with a printer (e.g., a laser printer), such as a stacker for stacking and storing paper which has been discharged from the printer and a hopper for storing paper to be fed to the printer.

(2) Description of the Prior Art

Known stackers serving as a paper accumulator unit are usually provided with a table that can be lifted and lowered, being kept in a horizontal condition. For example, continuous paper discharged from above is stacked on the table, being folded according to fold lines in such a manner that its front and back faces alternately face up. Such a table is lifted and lowered by the driving torque of the rotary shaft of a d.c. motor.

In order to prevent lowering of the table due to its own weight as well as the weight of paper stacked thereon when stopping the d.c. motor to suspend the table at a certain position, the driving torque of the rotary shaft of the d.c. motor for lifting or lowering the table is transmitted through a reduction gear mechanism composed of worm gears which provides a reduction ratio of 1:100 and is incapable of reversely rotating.

SUMMARY OF THE INVENTION

Such prior art units cannot be economically manufactured because of its expensive d.c. motor. Also, the reduction gear mechanism composed of worm gears is costly and inconvenient to be mounted and dismounted, which could be another obstacle to cost reduction.

The invention has been made in view of the above problems and therefore one of the objects of the invention is to provide a low-cost paper accumulator unit which provides sufficient power to hold the table at a stop position without the use of a d.c. motor and a reduction gear mechanism composed of worm gears.

The above object can be achieved by a paper accumulator unit according to the invention, the unit comprising:

(a) a table which can be lifted and lowered, being kept in a horizontal condition and on which paper which has been discharged from above is continuously stacked and stored;

(b) a stepping motor for lifting and lowering the table with the driving torque of its rotary shaft; and (c) an electromagnetic brake coupled to the rotary shaft of the stepping motor, which brakes the rotation of the rotary shaft when the brake is in a deenergized state.

Another form of the paper accumulator unit comprises:

(a) a table which can be lifted and lowered, being kept in a horizontal condition and stores a stack of paper which is to be continuously sent out therefrom, starting with the top;

(b) a stepping motor for lifting and lowering the table with the driving torque of its rotary shaft; and (c) an electromagnetic brake coupled to the rotary shaft of the stepping motor, which brakes the rotation of the rotary shaft when the brake is in a deenergized state.

As mentioned above, the invention employs, in place of a d.c. motor, a stepping motor that can be easily controlled, and employs, in place of a reduction gear mechanism composed of worm gears, an inexpensive electromagnetic brake that performs brake action in its deenergized state for holding the table at a stop position. This lead to cost reduction in manufacturing the paper accumulator unit. It should be noted that the electromagnetic brake is energized into its non-operated state when the rotary shaft of the stepping motor is rotated.

When stopping the rotation of the rotary shaft of the stepping motor, energizing current supplied to the stepping motor may be reduced or made zero and the electromagnetic brake may be brought into a deenergized state to perform its brake action, which prevents an increase in the temperature of the stepping motor. When the stepping motor drives the table to be lifted with the torque of the rotary shaft, the rotational speed of the rotary shaft may be controlled to increase step-wise or non step-wise, which enables the table to move at high speeds. Further, the rotation of the rotary shaft of the stepping motor may be suspended and the electromagnetic brake may be brought into its deenergized state according to necessity, which enables the table to be lifted and lowered by manual operation.

Even if there arises a need to transmit the driving torque of the rotary shaft of the stepping motor through a reduction gear mechanism to lift or lower the table, a reduction gear mechanism may be used which is not composed of worm gears incapable of reverse rotation but inexpensive spur gears for providing low reduction ratios. Such a reduction gear mechanism can be used in virtue of the electromagnetic brake that provides a holding force for keeping the table at a stop position.

The paper used herein may be continuous paper which can be stacked on the table, being folded according to fold lines formed thereon in such a manner that its front and back faces alternately face up, or may be discrete paper sheets to be stacked on the table.

According to the invention, the paper accumulator unit may include: (i) a swing guide positioned above the table, which swings about a specified swing angle to shake and guide the continuous paper so that the continuous paper is stacked on the table, being sequentially folded according to its fold lines with the front and back faces alternately facing up; and (ii) a stopper positioned on either side of the table with respect to the swing directions of the swing guide, which projects upward from the top face of the table. In such an arrangement, when the swing guide starts to guide the continuous paper, the swing guide is held at the side of the stopper as that the leading end of the continuous paper is shaken to strike against the stopper. This prevents an error in setting the continuous paper. One example of the setting error is such that, when lifting the table, the continuous paper cannot rest properly on the table, escaping into under a movable guide which is positioned on the other side of the table with respect to the swing directions of the swing guide, which includes at least a portion lying above the top face of the table and which can be adjusted to move in the swing directions of the swing guide.

According to the invention, the paper accumulator unit may include: (i) a swing guide positioned above the table, which swings about a specified swing angle to shake and guide the continuous paper such that the continuous paper is stacked on the table, being sequentially folded according to its fold lines with the front and back faces alternately facing up; (ii) a stopper positioned on either side of the table with respect to the swing directions of the swing guide, which projects upwardly from the top face of the table to prevent fold edges at one fold end of the paper from jetting out; and (iii) a movable guide positioned on the other side of the table with respect to the swing directions of the swing guide, which includes at least a portion lying above the top face of the table, which can be adjusted to move in the swing directions of the swing guide and which prevents fold edges at the other fold end of the paper from jetting out. In such an arrangement, the swing guide may be held so as to discharge the continuous paper in a substantially perpendicular direction to the table. This reduces the contact resistance between the inner face of the swing guide and the continuous paper in cases where the continuous paper is let out by manual operation, which is effective in preventing troubles such as paper jam.

The paper accumulator unit of the invention may be provided with a lower limit position detecting sensor for detecting the lower limit position of the table. Upon detection of the lower limit position by this sensor, at least the electromagnetic brake is brought into its deenergized state to perform brake action and, in addition, the rotation of the rotary shaft of the stepping motor is stopped, whereby occurrence of unexpected troubles can be prevented when maintenance is carried out. There also may be provided a lowering preventing mechanism which can be arbitrarily set to at least prevent the table from lowering. The use of such a mechanism also prevents occurrence of troubles during maintenance.

Other objects of the present invention will become apparent from the detailed description given hereinafter. However, it should be understood that the detailed description and specific example, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and accompanying drawings which are given by way of illustration only, and thus are not limitative of the present invention, and wherein:

FIG. 1 shows the overall construction of a printer;

FIG. 2 is a back view in perspective of a stacker unit;

FIG. 3 is a partially cut away back view in perspective of the stacker unit;

FIG. 4 is a partial elevation in perspective of the stacker unit;

FIG. 5 is a perspective view of a movable guide;

FIG. 6 is a diagram showing one example in which continuous paper is erroneously set on a table;

FIG. 7 is a perspective view of a lowering preventing member;

FIG. 8 is a time chart showing the states of members during preparatory stacking process;

FIG. 9 is a diagram showing the relationship between the level of the table and the maximum stacking amount of continuous paper;

FIG. 10 is a diagram illustrating the continuous paper in a discharged state while the table being lifted;

FIG. 11 is a perspective view of a lowering preventing member according to a modified example;

FIG. 12 is a diagram showing the overall construction of a second embodiment; and FIG. 13 is a schematic diagram showing the mechanism of the second embodiment.

DESCRIPTION OF THE PREFERRED EMBODIMENTS

Now, reference is made to the drawings for describing preferred embodiments of a paper accumulator unit according to the invention as applied to a printer such as a laser printer.

Figure 1:
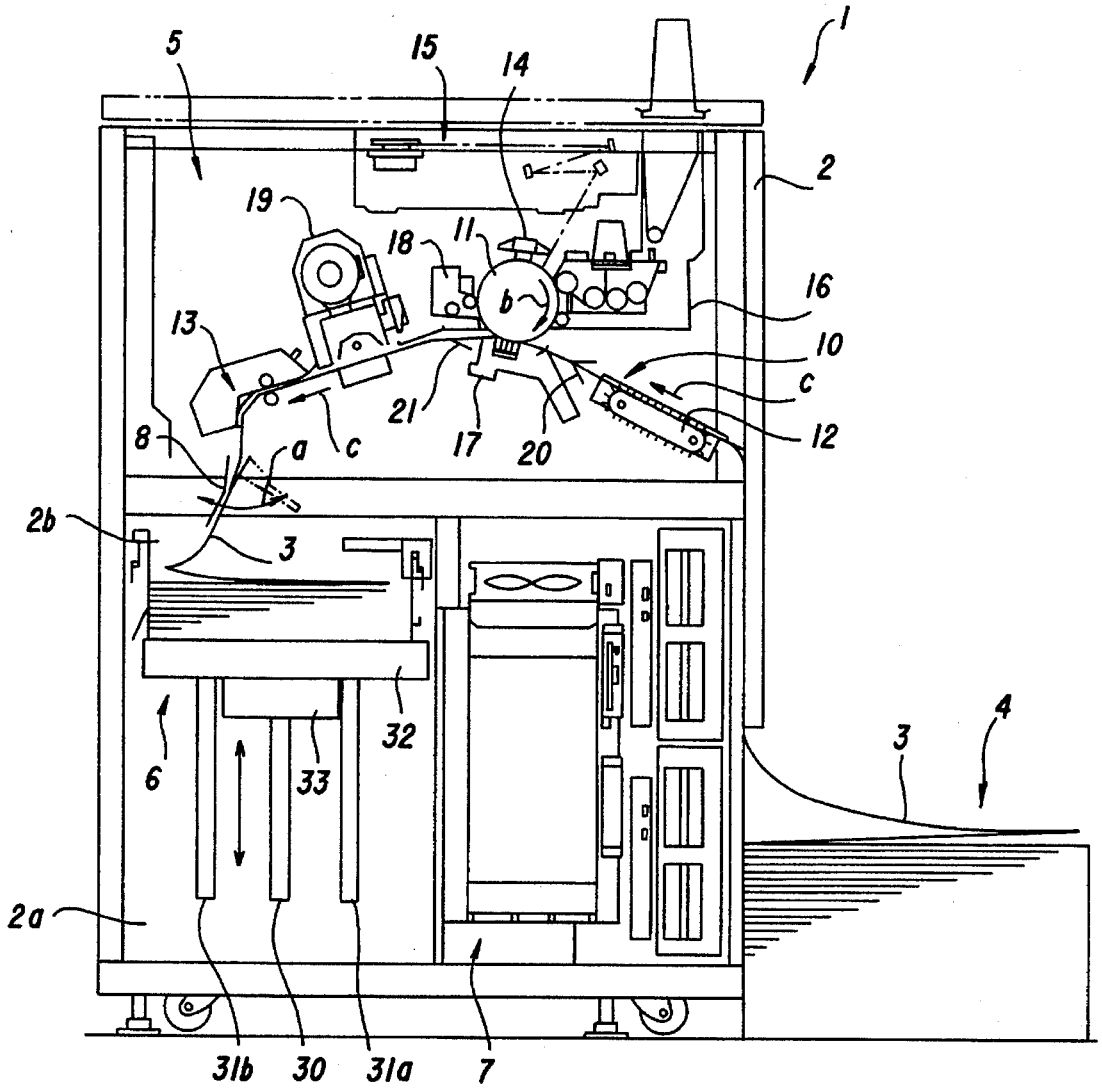
FIGS. 1 to 13 provide illustrations of preferred embodiments of the invention.

FIG. 1 shows a printer 1 employed in a first embodiment, in which a hopper unit 4 is provided on the right hand of a body frame 2. In the hopper unit 4, 1 i-inch continuous paper 3 in this embodiment is stacked, being folded according to fold lines in such a manner that the front and back faces of the continuous paper 3 alternately face up. Disposed in a lower left position within the body frame 2 is a stacker unit 6 in which the continuous paper 3, which has been subjected to printing in an electrophotographic unit 5 disposed in an upper position within the body frame 2, is stacked, being similarly folded according to the fold lines with the front and back faces alternately facing up. At a lower right position within the body frame 2, a control unit 7 for controlling the overall function of the printer 1 is disposed, while a swing guide 8 is disposed above the stacker unit 6. The swing guide 8 is driven by a driving motor (not shown) to swing about a specified angle in the swing directions a (shown in FIG. 1) on a specified cycle, according to the distance between two successive fold lines and the delivery speed of the continuous paper 3 which is delivered from the hopper unit 4 to the stacker unit 6 through the electrophotographic unit 5. The swing movement of the swing guide 8 allows the continuous paper 3 to be folded with its front and back faces alternately facing up.

There is provided an angled delivery path 10 through which the continuous paper 3 is delivered from the hopper unit 4 to the stacker unit 6 through the electrophotographic unit 5. Provided on the upper side of the vertex area of the angled delivery path 10 is a photosensitive drum 11 that rotates in the rotating direction b shown in FIG. 1. The photosensitive drum 11 is composed of a cylindrical body made from, for example, alumina; and a photosensitive layer made from a photoconductive material such as OPC and formed on the circumference of the cylindrical body.

On the upstream side of the photosensitive drum 11 in the delivery direction c (shown in FIG. 1) in which the continuous paper 3 is delivered through the delivery path 10, a tractor 12 is disposed for delivering the continuous paper 3 in the delivery direction c or in the reverse direction, with engagement pins engaged in feed holes provided on both sides of the continuous paper 3 so that slippage does not occur with respect to the delivery speed. On the downstream side of the photosensitive drum 11 in the delivery direction c, scuff rollers 13 are disposed for delivering the continuous paper 3 in the delivery direction c so as not to occur slippage with respect to the delivery speed. The scuff rollers 13 is comprised of a delivery roller and pinch roller which are arranged in opposing relationship to hold the continuous paper 3 between.

Disposed around the photosensitive drum 11 are (i) a charger 14 for uniformly, electrically charging the surface of the photosensitive drum 11, (ii) an exposing device 15 for directing light to areas other than an image formed on the surface of the photosensitive drum 11 electrically charged by the charger 14, in order to form an electrostatic latent image, (iii) a developing device 16 for forming a visible image by applying toner to the electrostatic latent image formed by the exposing device 15, the toner being opposite to the electrostatic latent image in polarity, (iv) a transfer device 17 for transferring the toner image carried by the photosensitive drum 11 onto the continuous paper 3 with the help of static electricity, by pressing the continuous paper 3 onto the toner image formed on the photosensitive drum 11 by the developing device 16 and then applying polarity opposite to that of the toner to the rear face of the continuous paper 3 by a corona wire, and (v) a cleaner 18 for removing residual toner which has not been transferred but remained on the photosensitive drum 11. These members are aligned in the listed order in the rotating direction b so as to face the photosensitive drum 11. The transfer device 17 is located as shown in FIG. 1 under the photosensitive drum 11 so as to face the photosensitive drum 11 with the delivery path 10 between.

On the downstream side of the photosensitive drum 11 in the delivery direction c and, more specifically, on the upper side of the delivery path 10 between the photosensitive drum 11 and the scuff rollers 13, there is provided a fixing device 19 for permanently fixing the toner image, which has been transferred onto the continuous paper 3 by the transfer device 17, by heat fusing with the use of a flash lamp in this embodiment. The fixing device 19 includes a smoke removal blower that is usually operated during printing operation to remove smoke and odor generated by heat fusing. Note that reference numerals 20, 21 denote paper guides for guiding the continuous paper 3, which are respectively disposed upstream and downstream of the photosensitive drum 11 in the delivery direction c.

With reference to the schematic mechanism diagrams of FIGS. 2 to 4, the stacker unit 6 will be described below.

Figure 2:
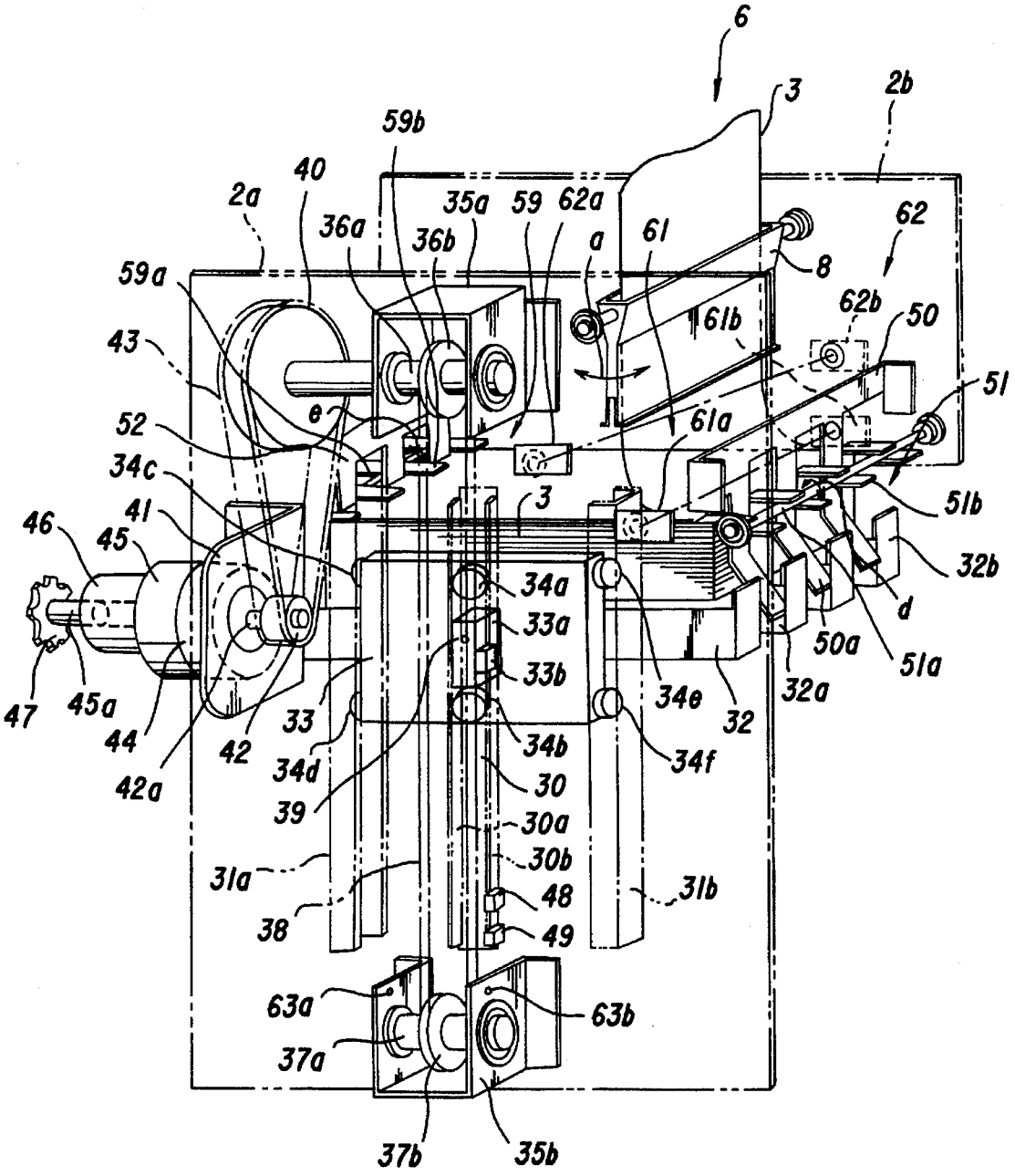
Figure 3:
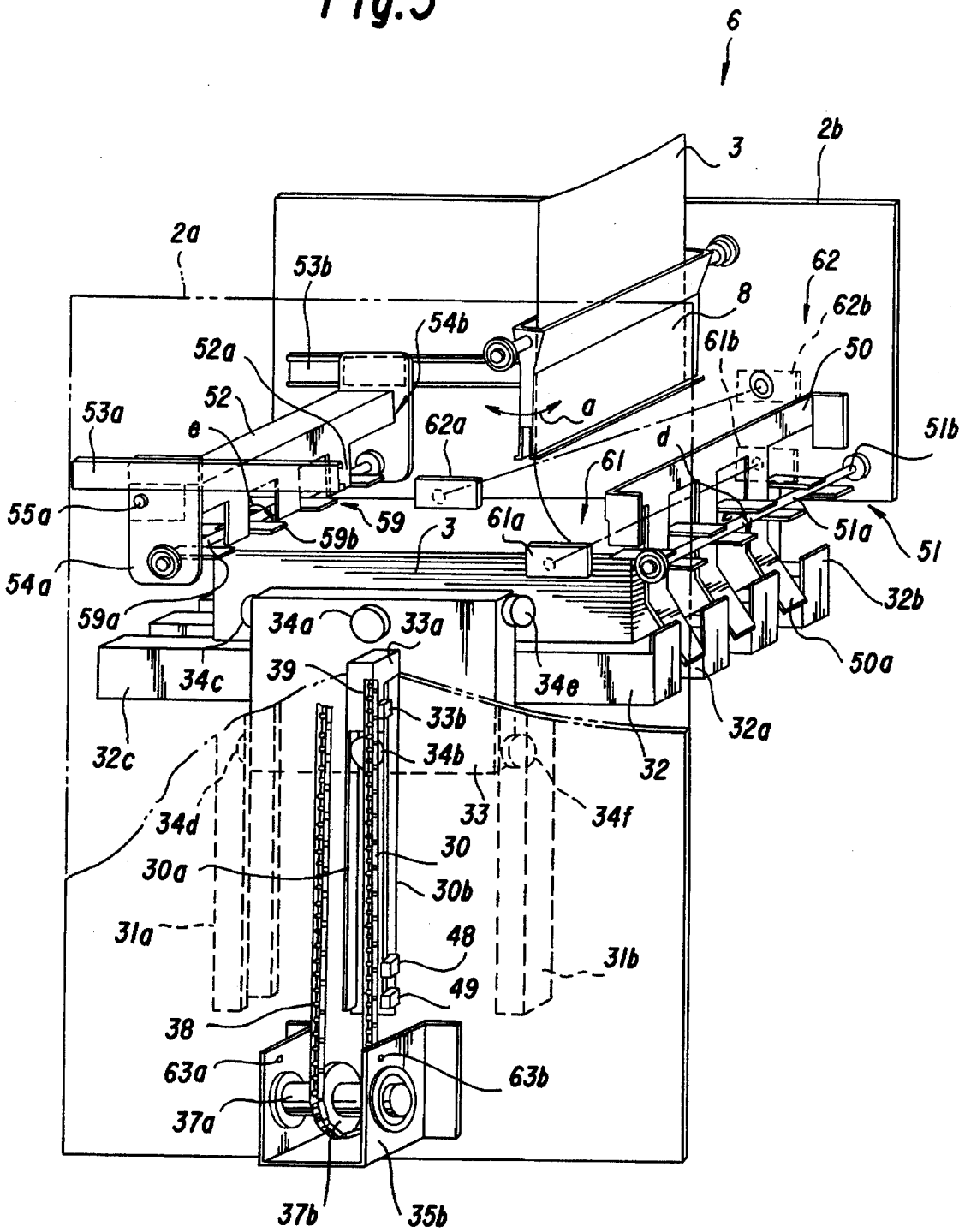

As shown in FIGS. 2 and 3, a rear frame portion 2*a* of the body frame 2 has a vertically extending slit guide groove 30 defined at the center thereof. The sides of the groove 30 bends to the front face (outer face) of the rear frame portion 2*a* to form side parts 30*a*, 30*b* which respectively take the shape of L in cross section. On the back face (inner face) of the rear frame portion 2*a*, a pair of guide rails 31*a*, 31*b* each having a D-shaped cross section vertically extend, being aligned in opposing relationship with the slit guide groove 30 between. Loosely fitted in the slit guide groove 30 and in the guide rails 31*a*, 31*b* are pairs of rollers 34*a* to 34*f* vertically aligned which are movable in a rolling fashion within the groove 30 and the guide rails 31*a*, 31*b*. These rollers 34*a* to 34*f* are pivotally supported on the center of the front face and side faces of a base frame 33 fixedly attached to the front face of a table 32 on which the continuous paper 3 discharged through the swing guide 8 is stacked, being folded according to the fold lines such that the front and back faces alternately face up. The provision of the slit guide groove 30, guide rails 31*a*, 31*b* and rollers 34*a* to 34*f* allows the table 32 to be lifted or lowered, being kept in a horizontal condition. On the front face of the rear frame portion 2*a*, a pair of brackets 35*a*, 35*b* each having a D-shaped section are vertically aligned in opposing relationship with the slit guide groove 30 between. Each of the brackets 35*a*, 35*b* includes a sprocket 36*b* (37*b*) which has a rotary shaft 36*a* (37*a*) pivotally journaled in the bracket 35*a* (35*b*). An endless chain 38 is tensioned and wound around the sprockets 36*b* and 37*b*, being engaged with a block 33*a* by a bolt 39 as shown in FIGS. 2 and 3. The block 33*a* projects from a position between the pair of rollers 34*a* and 34*b* pivotally supported on the center of the surface of the base frame 33, being loosely fitted in the slit guide groove 30 as shown in FIGS. 2 and 3.

The rotary shaft 36*a* is a common rotary shaft to the upper sprocket 36*b* and a large-diameter pulley 40 attached to the rotary shaft 36*a*. Disposed under the large-diameter pulley 40 is a small-diameter pulley 42 having a rotary shaft 42*a* which is pivotally supported by a supporting plate 41 fixed to the front face of the rear frame portion 2*a*. A timing belt 43 is tensioned, being wound around the large-diameter pulley 40 and small-diameter pulley 42. The rotary shaft 42*a* is coupled to a rotary shaft 45*a* of a stepping motor 45 through a reduction gear mechanism 44 composed of spur gears. The reduction ratio of the reduction gear mechanism 44 is about 1:10. The stepping motor 45 is provided with a known deenergization-type electromagnetic brake 46 which is operated when its electromagnetic coil is in a deenergized state to brake the rotation of the rotary shaft 45*a* of the stepping motor 45. The rotary shaft 45*a* of the stepping motor 45 is provided with a handle 47 by which the rotary shaft 45*a* can be manually rotated to lift or lower the table 32. The manual operation by the use of the handle 47 is performed, with the deenergization-type electromagnetic brake 46 being out of operation. The electromagnetic brake 46 is brought into non-operated state through such procedure: the operator depresses a press button (not shown) to forcibly supply an energizing current to the electromagnetic coil of the electromagnetic brake 46 for a specified time so that the electromagnetic coil is brought into its energized state, releasing the electromagnetic brake 46 from brake action. A driving torque generated by the forward or reverse rotation of the rotary shaft 45*a* of the stepping motor 45 is transmitted to the reduction gear mechanism 44, small-diameter pulley 42, timing belt 43, large-diameter pulley 40, the pair of sprockets 36*b*, 37*b*, endless chain 38 and other members so that the table 32 is lifted or lowered with this driving torque.

On the right side of the block 33*a* projecting from the base frame 33, a projection 33*b* is provided for operating limit switches 48, 49 which are arranged in vertical alignment on the right of a lower position of the slit guide groove 30. Of these limit switches, the upper limit switch 48 detects the table 32 when it reaches a lower limit position where the continuous paper 3, which is stacked on the table 32 and folded according to the fold lines such that the front and back faces alternately face up, is cut at a proper position and taken out of the table 32. The lower limit switch 49 detects the table 32 when it lowers beyond the lower limit position. Upon detection, the lower limit switch 49 turns off the main power source for the stacker unit 6, thereby stopping the stepping motor 45 and brings the electromagnetic coil of the deenergization-type electromagnetic brake 46 into its deenergized state, thereby operating the electromagnetic brake 46 to prevent the overrun of the table 32.

Figure 4:
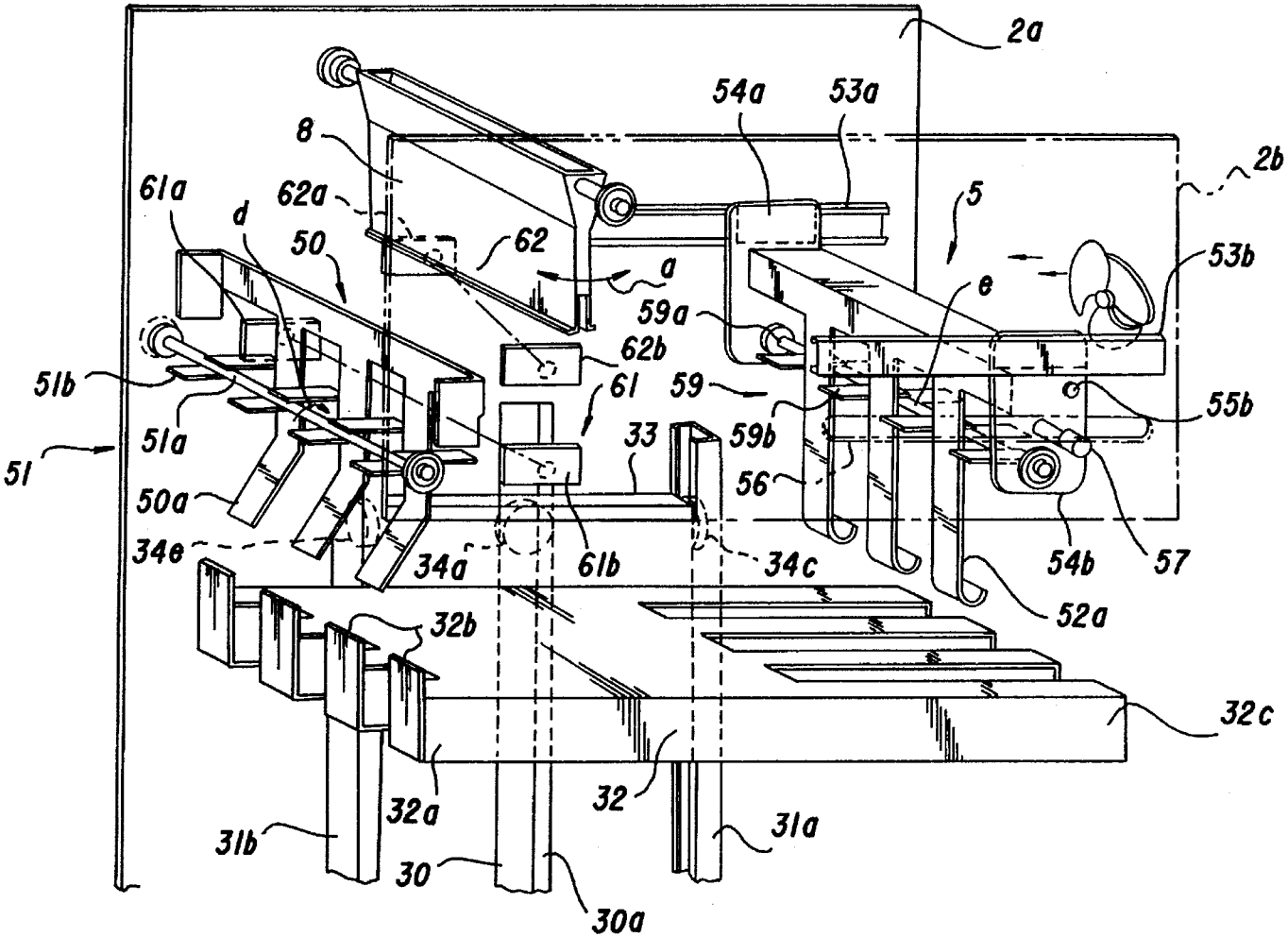
Figure 5:
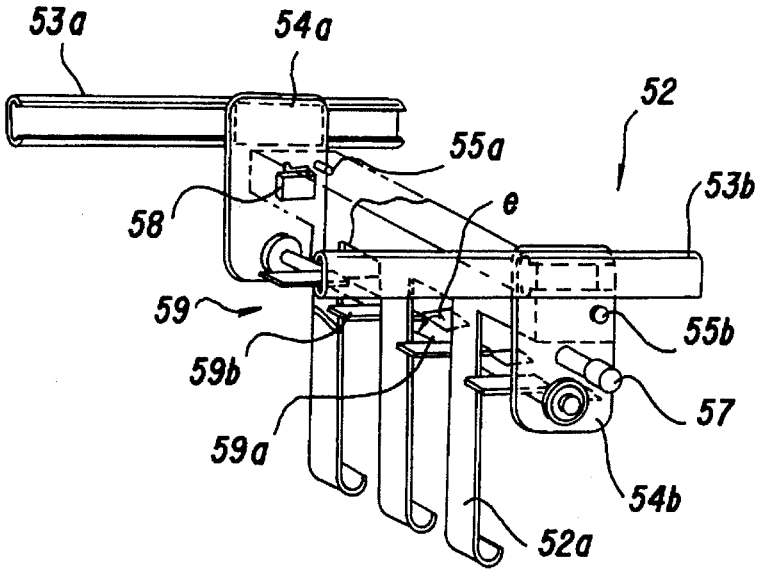
Figure 6:
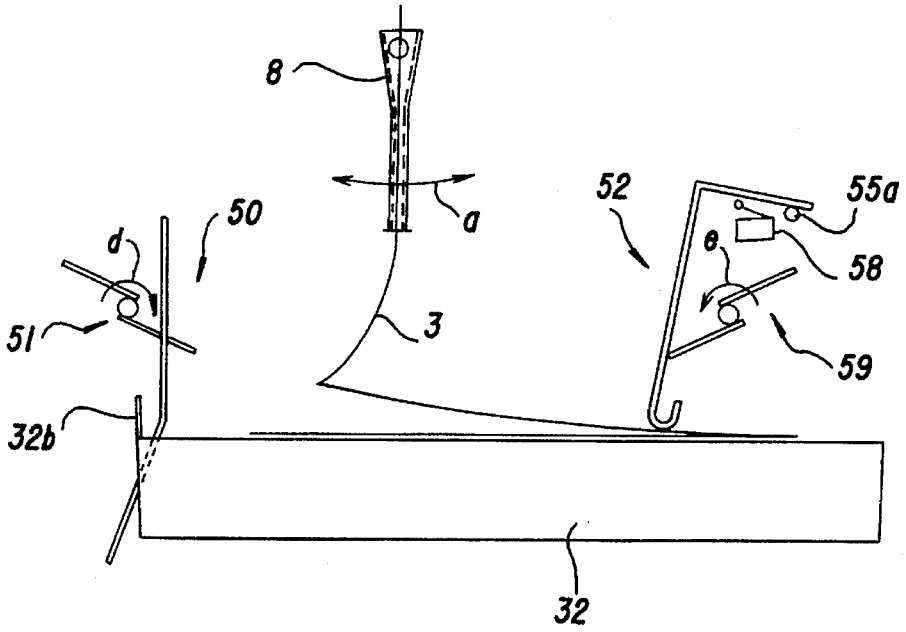

Referring to FIG. 4, the left side of the table 32 with respect to the swing directions a (shown in FIG. 4) of the swing guide 8 which swings about a specified angle is made in the form of shallow teeth 32*a*. Each tooth 32*a* has a stopper 32*b* at the tip thereof. The stoppers 32*b* project upward from the top face of the table 32 to prevent the leading end and fold edges at one fold end of the continuous paper 3 from jutting out. The right side of the table 32 is made in the form of deep teeth 32*c*. A fixed guide 50 having suspending teeth 50*a* is provided above the left side of the table 32. When the table 32 is lifted, the teeth 50*a* are loosely fitted between the shallow teeth 32*a* to prevent the fold edges at one fold end of the continuous paper 3 from jutting out. The fixed guide 50 lies, being fixed in horizontal condition between the rear frame portion 2*a* and front frame portion 2*b* of the body frame 2. The leading ends of each tooth 50*a* bend to the left so as to rightwardly push the continuous paper 3, which is offset toward the stopper 32*b*, to the correct position (i.e., the center of the table 32) as the table 32 rises. An impeller 51 is provided on the left of the fixed guide 50. The impeller 51 is composed of (i) a rotary shaft 51*a* that is horizontally journaled in the rear frame portion 2*a* and the front frame portion 2*b* and that is rotated in the rotating direction d shown in FIG. 4 by means of a driving motor (not shown)and (ii) blades 51*b* attached to the rotary shaft 51*a* so as to move with play between the teeth 50*a* of the fixed guide 50. On the right of the table 32, there is provided a movable guide 52 for preventing fold edges at the other fold end of the continuous paper 3 from jutting out. The movable guide 52 has teeth 52*a* each of which has a rightwardly curled leading end and which are loosely inserted between the deep teeth 32*c* as the table 32 rises. The movable guide 52 is pivotally supported by a pair of supporting shafts 55*a*, 55*b* between hanging boards 54*a*, 54*b* which are suspended by a pair of guide rails 53*a*, 53*b* respectively so as to be horizontally movable, being guided by the guide rails 53*a*, 53*b*. The guide rails 53*a*, 53*b* each having a C-shaped cross section are horizontally disposed in opposing relationship on the rear frame portion 2*a* and the front frame portion 2*b*, respectively. A sliding knob 57 which passes through a slit groove 56 with play is projected from the hanging board 54*b* on the side of the front frame portion 2*b*. The slit groove 56 is defined in the front frame portion 2*b*, extending in a horizontal direction. By means of the sliding knob 57, the movable guide 52 is controlled to move horizontally in accordance with the distance between two successive fold lines of the continuous paper 3. A limit switch 58 is provided on the hanging board 54*a* on the side of the rear frame portion 2*a* and positioned under the movable guide 52. When the teeth 52*a* of the movable guide 52 are in their vertically suspending state as shown in FIG. 5, the limit switch 58 is operated, coming in contact with the underside of the movable guide 52, and when the teeth 52*a* are in their inclined state as shown in FIG. 6 which occurs where the continuous paper 3 is erroneously set, the limit switch 58 is not operated since it is out of contact with the underside of the movable guide 52, whereby the limit switch 58 detects erroneous setting of the continuous paper 3. An impeller 59 composed of a rotary shaft 59*a* and blades 59*b* is positioned on the right of the movable guide 52. The rotary shaft 59*a* is journaled within the hanging boards 54*a*, 54*b* in a horizontal condition and driven by a driving motor (not shown) to rotate in the rotating direction e shown in FIG. 4. The blades 59*b* are attached to the rotary shaft 59*a* so as to move between the teeth 52*a* of the movable guide 52, with play.

The function of the impellers 51, 59 is to fold the continuous paper 3 discharged from the swing guide 8 according to the fold lines. The impellers 51, 59 rotate in compliance with the specified swing angle and swing cycle of the swing guide 8, and when the impellers 51, 59 stop and the stacked continuous paper 3 is taken out of the table 32, the blades 51*b*, 59*b* are stopped in an upright condition. Especially when the movable guide 52 moves, the blades 59*b* are stopped upright in order not to disturb the movement of the movable guide 52.

In FIG. 4, there is provided a fan 60 on the right of the movable guide 52. The fan 60 is driven by a driving motor (not shown) to send air toward the leading end of the swing guide 8 after a start of automatic loading until the leading end of the continuous paper 3 reaches the table 32, which prevents the leading end of the continuous paper 3 discharged from the swing guide 8 during automatic loading from being undesirably deflected or bent so that the continuous paper 3 can reach a right position and can be properly folded. The fan 60 is useful particularly when the continuous paper 3 is thin or its leading end is curled, or when the distance between two successive fold lines of the continuous paper 3 is short and therefore the swing angle of the swing guide 8 is narrow.

Referring to FIGS. 2 and 3, a transmission-type photosensor 61 is provided for detecting the top of the continuous paper 3 stacked on the table 32 and folded according to the fold lines with its front and back faces alternately facing up. The photosensor 61 is comprised of a light projector 61*a* attached to the rear frame portion 2*a* and a light receptor 61*b* attached to the front frame portion 2*b*, these members 61*a*, 61*b* being in opposing relationship to detect the top of the continuous paper 3. During paper stacking operation, the table 32 is lifted or lowered, driven by the stepping motor 45 such that the top of the continuous paper 3 stacked on the table 32 is at the level of the detecting position for the photosensor 61. Another transmission type photosensor 62 is provided for detecting an error in folding the continuous paper 3 on the table 32 according to the fold lines with its front and back faces alternately facing up. The photosensor 62 is comprised of a light projector 62*a* attached to the rear frame portion 2*a* and a light receptor 62*b* attached to the front frame portion 2*b*. The light projector 62*a* and the light receptor 62*b* face each other with the continuous paper 3 discharged from the swing guide 8 between. The photosensor 62 detects the continuous paper 3 periodically discharged from the swing guide 8 during paper stacking operation and if a failure occurs in folding the continuous paper 3, the detection by the photosensor 62 will not be carried out or delay. Therefore, erroneous folding of the continuous paper 3 can be detected by checking whether or not the detection by the photosensor 62 is periodical. In the event of erroneous folding, an alarm will go off.

Figure 7:
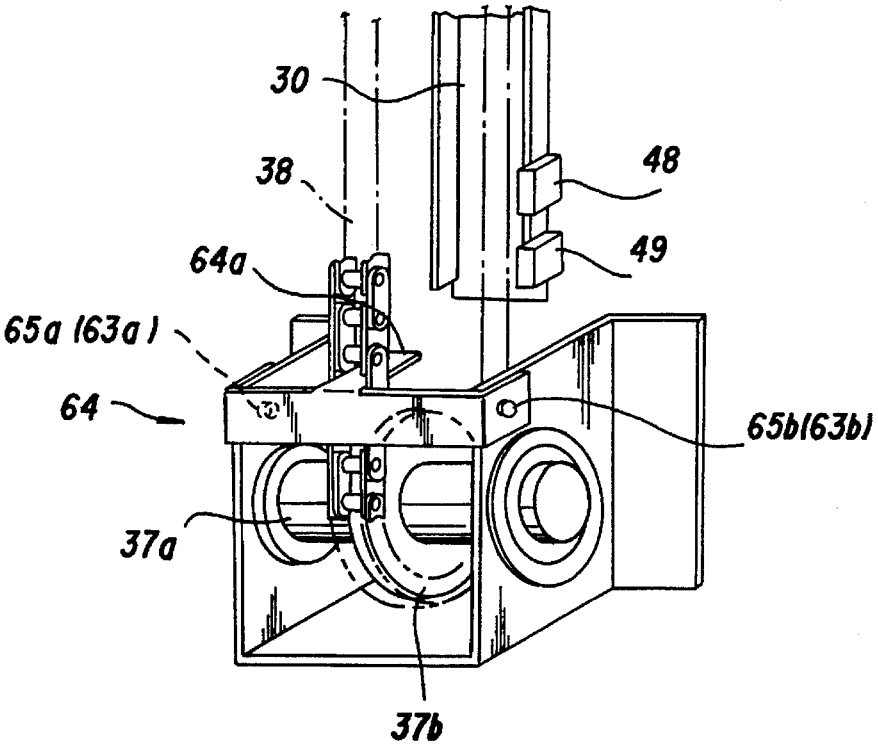

The lower bracket 35*b* has a pair of screw holes 63*a*, 63*b* pierced at opposed sides. By threading screws 65*a*, 65*b* into these screw holes 63*a*, 63*b*, a lowering preventing member 64 for preventing the travel of the endless chain 38 and especially the descent of the table 32 due to its own weight is attached to the bracket 35*b*, with its tongue 64*a* inserted in the endless chain 38 as shown in FIG. 7. The provision of the lowering preventing member 64 prevents the undesirable rising and lowering of the table 32 during maintenance for the stacker unit 6. For example, when the stepping motor 46 is seized, replacement can be easily, securely carried out by one person.

The control unit 7 controls the whole function of the printer 1. Next, the control of the operation of the stacker unit 6 by the control unit 7 will be described. Although the components of the control unit 7 are not shown in the drawings, it is composed of (i) a central processing unit (CPU)for executing a specified program; (ii) a read-only memory (ROM)for storing the program; (iii) a random access memory (RAM) which serves as a working memory necessary for executing the program and as registers for various functions; and (iv) a timer for measuring elapsed time for an event in the program.

During paper stacking operation, the continuous paper 3 discharged from the swing guide 8 which cyclically swings about a predetermined swing angle according to the delivery speed of the continuous paper 3 and the distance between two successive fold lines is stacked on the table 32. The continuous paper 3 is folded between the fixed guide 50 and the movable guide 52 by means of the impellers 51, 59, according to the fold lines such that its front and back faces alternately face up. The top of the continuous paper 3 stacked on the table 32 is detected by the photosensor 61, while the table 32 is lifted and lowered, driven by the stepping motor 45 such that the top of the continuous paper 3 is always kept at the detecting position for the photosensor 61. When the continuous paper 3 is taken out of the table 32 after completion of a series of printing processes, when the space on the table 32 is full of the continuous paper 3 and therefore the continuous paper 3 is taken out of the table 32, or when a jam of the continuous paper 3 occurs, the table 32 is lowered automatically or manually (such operation for lowering the table 32 is not described herein) to the lower limit position where the table 32 is detected by the limit switch 48 when it reaches. At the lower limit position, the continuous paper 3 stacked on the table 32 is cut at an appropriate position and is taken out of the table 32.

Figures 8A, 8B, 8C, 8D, 8E, 8F, 8G, 8H, 8I:
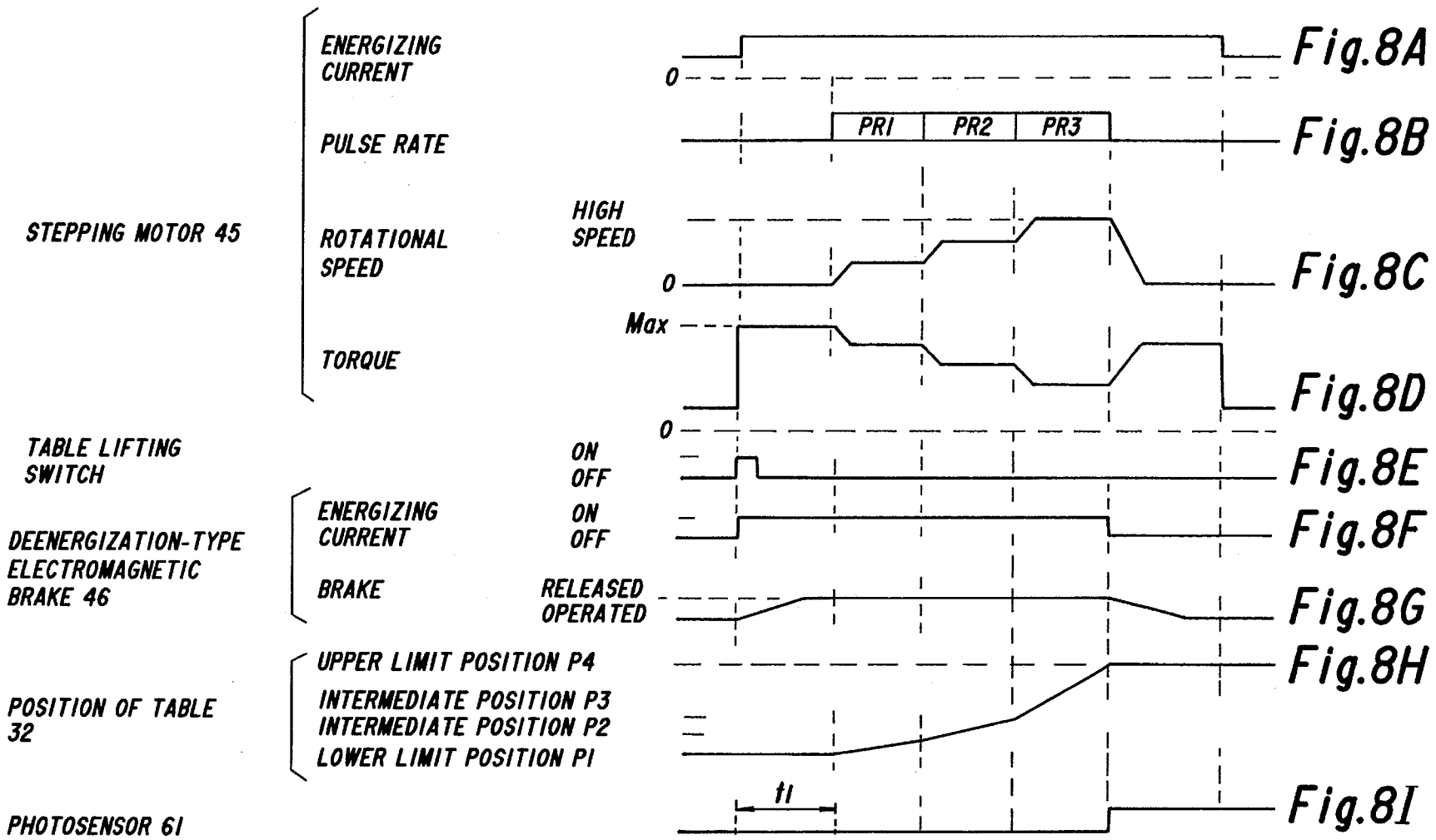

Thereafter, a table lifting switch (not shown) is depressed by the operator and then preparatory stacking process starts. This process will be explained with reference to FIG. 8.

It should be noted that when the rotation of the rotary shaft 45*a* of the stepping motor 45 is stopped before depressing the table lifting switch, a rise in the temperature of the stepping motor 45 is prevented, by supplying small energizing current to the stepping motor 45. At that time, no energizing current is supplied to the electromagnetic coil of the deenergization-type electromagnetic brake 46. Accordingly, while the stepping motor 45 retains some driving torque of the rotary shaft 45*a*, the deenergization-type electromagnetic brake 46 is fully operated to maintain the table 32 at the lower limit position.

Then, the energizing current supplied to the stepping motor 45 is increased by depressing the table lifting switch, while energizing current is supplied to the electromagnetic coil of the deenergization-type electromagnetic brake 46. The supply of energizing current to the electromagnetic coil of the deenergization-type electromagnetic brake 46 brings the coil into its energized state. After an elapse of time $t_1$, that is, after the brake action has been completely suspended, the rotary shaft 45*a* of the stepping motor 45 rotates at the lowest pulse rate PR1 so that the table 32 rises at a low speed. After the table 32 has ascended a predetermined distance, the rotary shaft 45*a* of the stepping motor 45 rotates at the second lowest pulse rate PR2, so that the table 32 rises at a medium speed. After the table 32 has further ascended another predetermined distance, the rotary shaft 45*a* of the stepping motor 45 rotates at the highest pulse rate PR3, so that the table 32 rises at a high speed. When the photosensor 61 detects the top of the continuous paper 3 stacked on the table 32 or when it detects the top of the table 32 in cases where no paper is stacked on the table 32, the rotation of the rotary shaft 45*a* of the stepping motor 45 is stopped and the supply of energizing current to the electromagnetic coil of the deenergization-type electromagnetic brake 46 is stopped, bringing the coil into its deenergized state. This deenergized state allows the deenergization-type electromagnetic brake 46 to start its braking action, and then, the energizing current of the stepping motor 45 is reduced.

Figure 9:
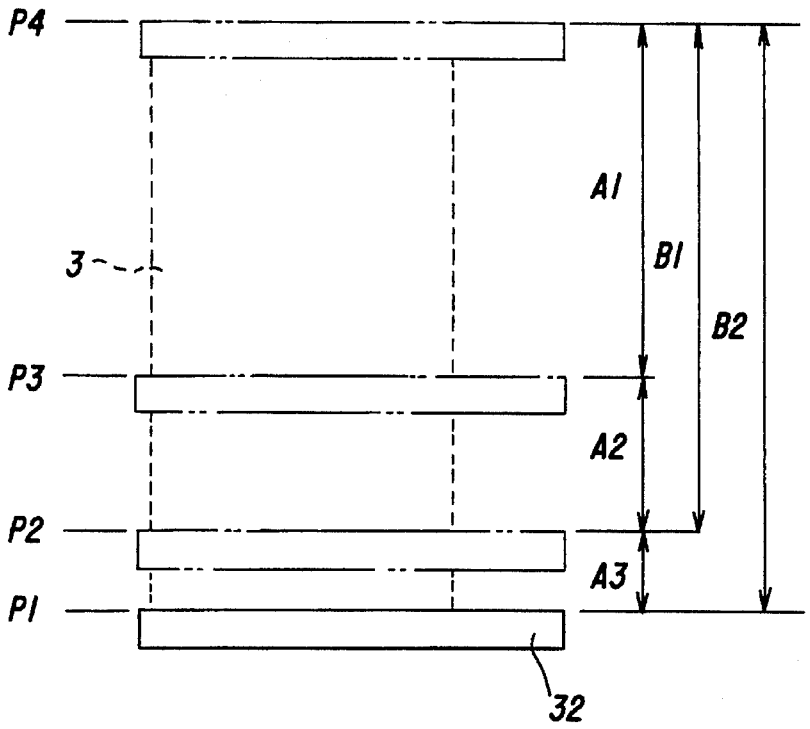

In the preparatory stacking process, the rotational speed of the rotary shaft 45*a* of the stepping motor 45 is increased step-wise, thereby increasing the lifting speed of the table 32 step-wise, which enables the rotary shaft 45*a* of the small-sized stepping motor 45 to generate a desired torque sufficient to lift the table 32 to a predetermined position for a short time. The reason for this will be explained referring to FIG. 9. It should be noted that the torque produced by the rotary shaft 45*a* of the stepping motor 45 is generally inversely proportional to the rotational speed of the rotary shaft 45*a*.

The table 32 is first positioned at the lower limit position P1 where it is detected by the limit switch 48. In cases where the continuous paper 3 is not stacked on the table 32, the table 32 is driven to rise from the lower limit position P1 passing intermediate positions P2, P3 until the top of the table 32 reaches an upper limit position P4 where it is detected by the photosensor 61. On the other hand, in cases where the continuous paper 3 is stacked on the table 32, the table 32 rises until the top of the stacked continuous paper 3 is detected by the photosensor 61 and therefore the table 32 itself rises to somewhere before the upper limit position P4, depending on the amount of the continuous paper 3 stacked. It is understood that the more the table 32 rises, the less the amount of the continuous paper 3 is stacked on the table 32. Therefore, if the table 32 can rise only to the intermediate position P3, the amount of the continuous paper 3 stacked on the table 32 is level A1, and similarly if the table 32 can rise only to the intermediate position P2, the amount of the continuous paper 3 stacked on the table 32 is level B1 (=A1+A2).

On assumption that the amount of the continuous paper 3 stacked on the table is level B2 (=A1+A2+A3) when the table 32 is somewhere in the area from the lower limit position P1 to the intermediate position P2, the rotary shaft 45*a* needs to be rotated at a rotational speed which can generate torque sufficient to oppose the load corresponding to level B2. When the table 32 is in the area from the intermediate position P2 to the intermediate position P3, the maximum amount of the continuous paper 3 stacked on the table 32 does not exceed level B1 (=A1+A2). In this case, the torque necessary to oppose the load corresponding to this amount is obviously lower than the first case so that the rotational speed of the rotary shaft 45*a* can be increased. Similarly, when the table 32 is in the area from the intermediate position P3 to the upper limit position P4, the maximum amount of the continuous paper 3 stacked on the table 32 does not exceed level A1. The torque necessary to oppose the load corresponding to this amount is again lower than the second case, so that the rotational speed of the rotary shaft 45*a* can be further increased.

In contrast with the invention, the conventional system requires a large-sized stepping motor and a lot of time for lifting, since the table 32 is lifted at a lifting speed based on the slowest rotational speed (i.e., the rotational speed when the amount of the continuous paper 3 stacked on the table 32 is level B2) of the rotary shaft 45*a* of the stepping motor 45.

It should be noted that the intermediate positions P2, P3 can be detected simply by obtaining the rotational speed of the rotary shaft 45*a* of the stepping motor 45 and rotating time when the rotary shaft 45*a* rotates at that speed or by obtaining the number of pulses fed to the stepping motor 45. This eliminates the need for detection of the actual amount of the continuous paper 3 stacked on the table 32.

Figure 10:
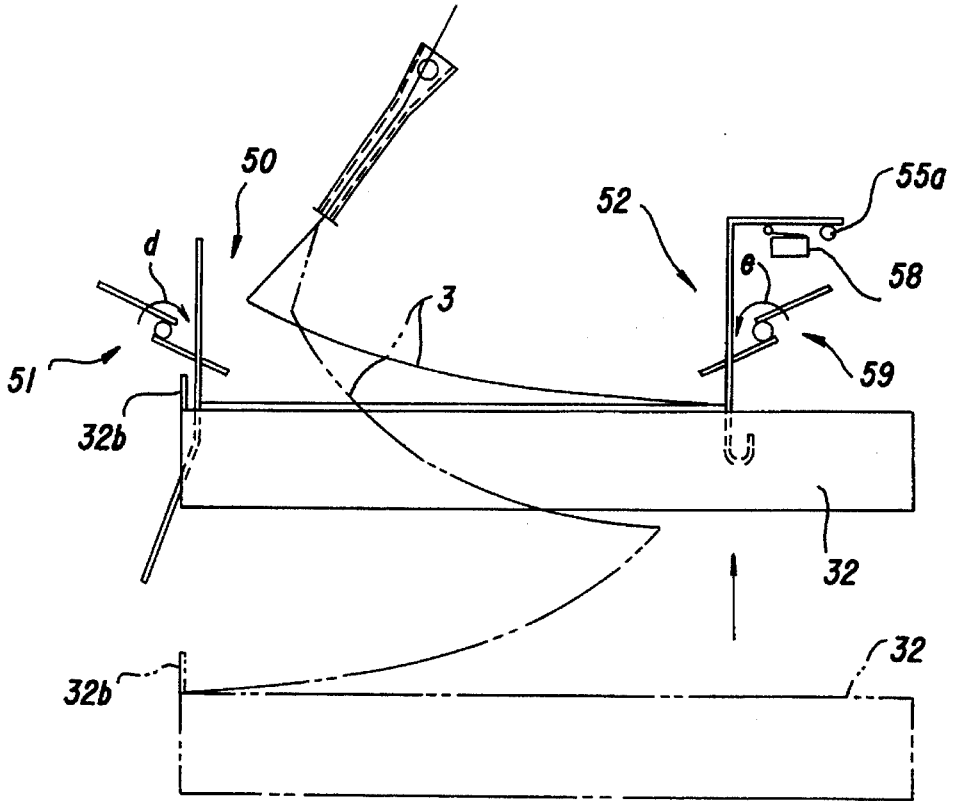

Between the time when the table 32 has started rising from the lower limit position P1 and the time when the top of the continuous paper 3 stacked on the table 32 or the top of the table 32 (in cases where the continuous paper 3 is not stacked on the table 32) is detected by the photosensor 61, the swing guide 8 is held on the side of the stopper 32*b* as shown in FIG. 10, until the continuous paper 3 starts shaking distribution. As the swing guide 8 being held on the side of the stopper 32*b*, the continuous paper 3 is put aside on the side of the stopper 32*b*, when the table 32 is positioned at the lower limit position P1. This prevents the fold edges of the continuous paper 3 from escaping into under the movable guide 52 by the upward movement of the table 32, so that the continuous paper 3 properly rests between the fixed guide 50 and the movable guide 52 as shown by the solid line in FIG. 10.

Now, there will be given an explanation on the case where a manual field switch (not shown) is depressed by the operator, thereby manually sending the continuous paper 3 to discharge the continuous paper 3 from the swing guide 8 onto the table 32.

The swing guide 8 is so held as to discharge the continuous paper 3 substantially vertically onto the table 32. Therefore, the contact resistance generated between the inner face of the swing guide 8 and the continuous paper 3 is reduced, and especially the fold lines of the continuous paper 3 are prevented from being trapped by the outlet edges of the swing guide 8, which prevents troubles such as paper jam.

Next, there will be given an explanation on the case where an automatic loading switch (not shown) is depressed by the operator to discharge new continuous paper 3 from the swing guide 8 onto the table 32.

The swing guide 8 swings to be held on the side of the photosensor 62, that is, on the side of the stopper 32*b* so that the leading end of the discharged continuous paper 3 is detected by the photosensor 62. In this case, the continuous paper 3 is not periodically detected by the photosensor 62, so that it is determined that erroneous folding of the continuous paper 3 has occurred and the alarm goes off. This prevents troubles such as paper jam.

According to the foregoing embodiment, the table 32 is lifted or lowered by the driving torque of the rotary shaft 45*a* of the stepping motor 45 and a force for holding the table 32 when the table 32 is stopped is obtained by bringing the electromagnetic coil of the deenergization-type electromagnetic brake 46 into a deenergized state. This ensures that the table 32 is held at a suitable position even when power failure occurs, which improves the reliability of the system. The stepping motor 45 and the deenergization-type electromagnetic brake 46 are inexpensive. In addition, they do not require coupling and therefore the number of parts can be reduced. With these advantages, the paper accumulator unit of the above embodiment can achieve miniaturization and considerable cost reduction, unlike the conventional systems which require a d.c. motor and a reduction gear mechanism composed of worm gears.

The power source for supplying energizing current to the electromagnetic coil of the deenergization-type electromagnetic brake 46 is made up of a controlled power source and a forced (normal) power source. The controlled power source is controlled by the control unit 7 so as to be turned on in relation to the rotation of the rotary shaft 45*a* of the stepping motor 45 or turned on for a specified time when the operator depresses the press button as described above. The forced power source is turned on, being forcibly energized, when the operator operates the change-over switch to switch from the controlled power source to this forced power source. Switching between the controlled power source and the forced power source is not necessarily carried out by the operation of the change-over switch by the operator, but may be carried out by the operator's operation to selectively connect one terminal of the connector of the deenergization-type electromagnetic brake 46 to the other terminal of the connector of the controlled power source or to the other terminal of the connector of the forced power source.

While the fan 60 of the foregoing embodiment is positioned on the right of the movable guide 52 as shown in FIG. 4, the fan may be disposed at different positions as far as air can be sent to the leading end of the swing guide 8. For example, within the table 32, directed to the leading end of the swing guide 8 and the top face of the table 32 is provided with vent holes through which air passes whereby air can be sent to the leading end of the swing guide 8.

While the rotational speed of the rotary shaft 45*a* of the stepping motor 45 is step-wise increased through three stages in the preparatory stacking process in the foregoing embodiment, it may be step-wise increased through two, four or more stages. Optionally, the rotational speed may not be increased step-wise, but increased continuously.

In the foregoing embodiment, when the rotation of the rotary shaft 45*a* of the stepping motor 45 is stopped, the supply of energizing current to the stepping motor 45 is reduced. However, it is also possible to supply no energizing current to the stepping motor 45 during the suspension of the rotary shaft 45*a*.

Although the invention has been particularly described with the continuous paper 3 in the foregoing embodiment, it is readily apparent to one skilled in the art that discrete paper sheets may be stacked on the table 32.

Figure 11:
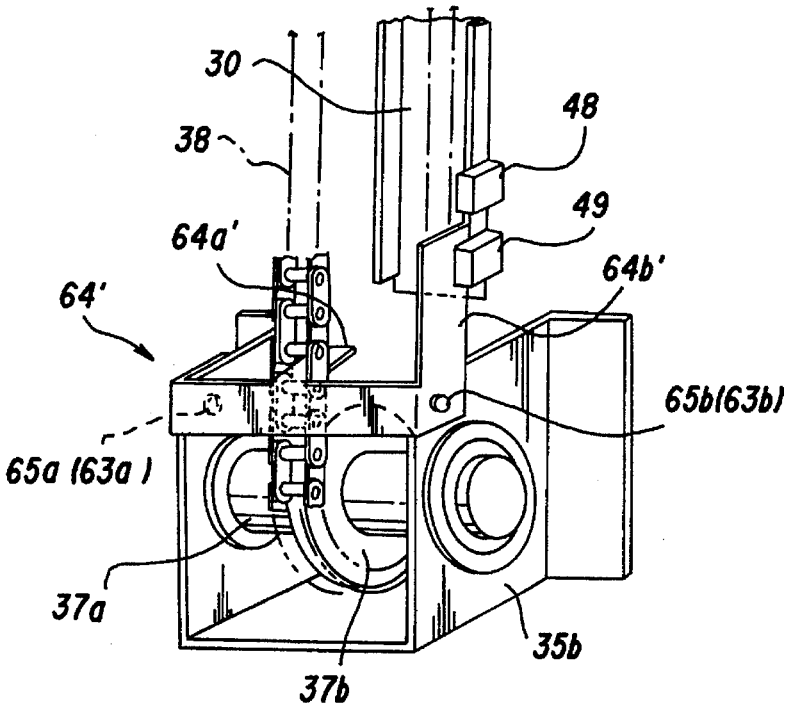

The lowering preventing member 64 used in the foregoing embodiment for preventing the travel of the endless chain 38 and especially the descent of the table 32 due to its own weight etc. is often left without being dismounted after use. If the stacker unit 6 is actuated with the lowering preventing member 64 mounted, the stepping motor 45 would be seized or the endless chain 38 would be cut. In order to avoid such undesirable situations, there is proposed a modified example of the lowering preventing member. The lowering preventing member 64' is attached to the bracket 35*b* by the screws 65*a*, 65*b* with the tongue 64*a'* inserted in the endless chain 38 as shown in FIG. 11, so that the travel of the endless chain 38 can be prevented. The lowering preventing member 64' includes an abutment part 64' and turns off the main power source by utilizing the abutment part 64' for putting the limit switch 49 in operation, so that the same condition when the table 32 is lowered exceeding the lower limit position can be achieved, resulting in turn-off of the main power source for the stacker unit 6. The use of the lowering preventing member 64' prevents the travel of the endless chain 38, while it allows the stepping motor 45 to be stopped and the electromagnetic coil of the deenergization-type electromagnetic coil 46 to come into its deenergized state to initiate the braking operation.

Figure 12:
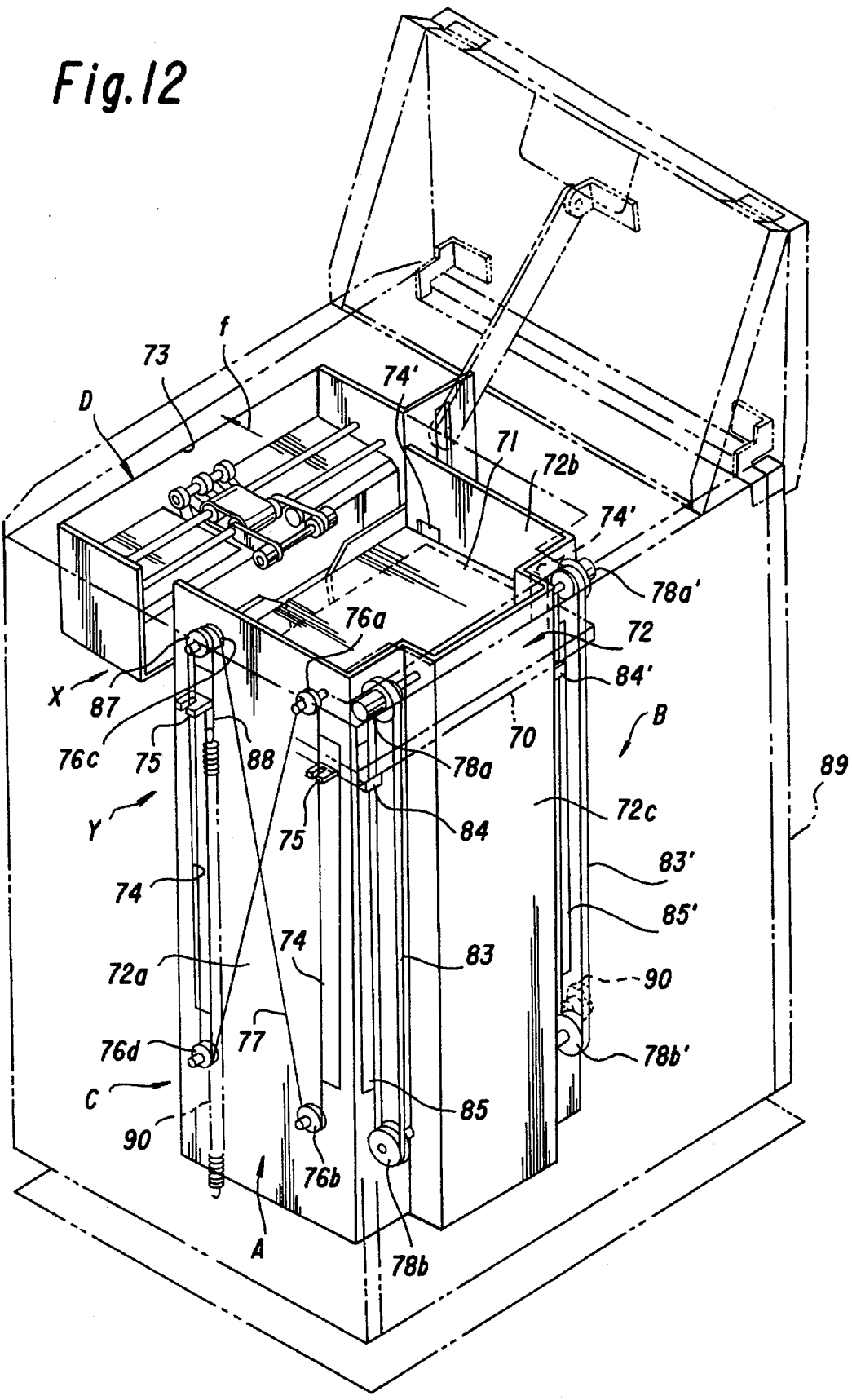
Figure 13:
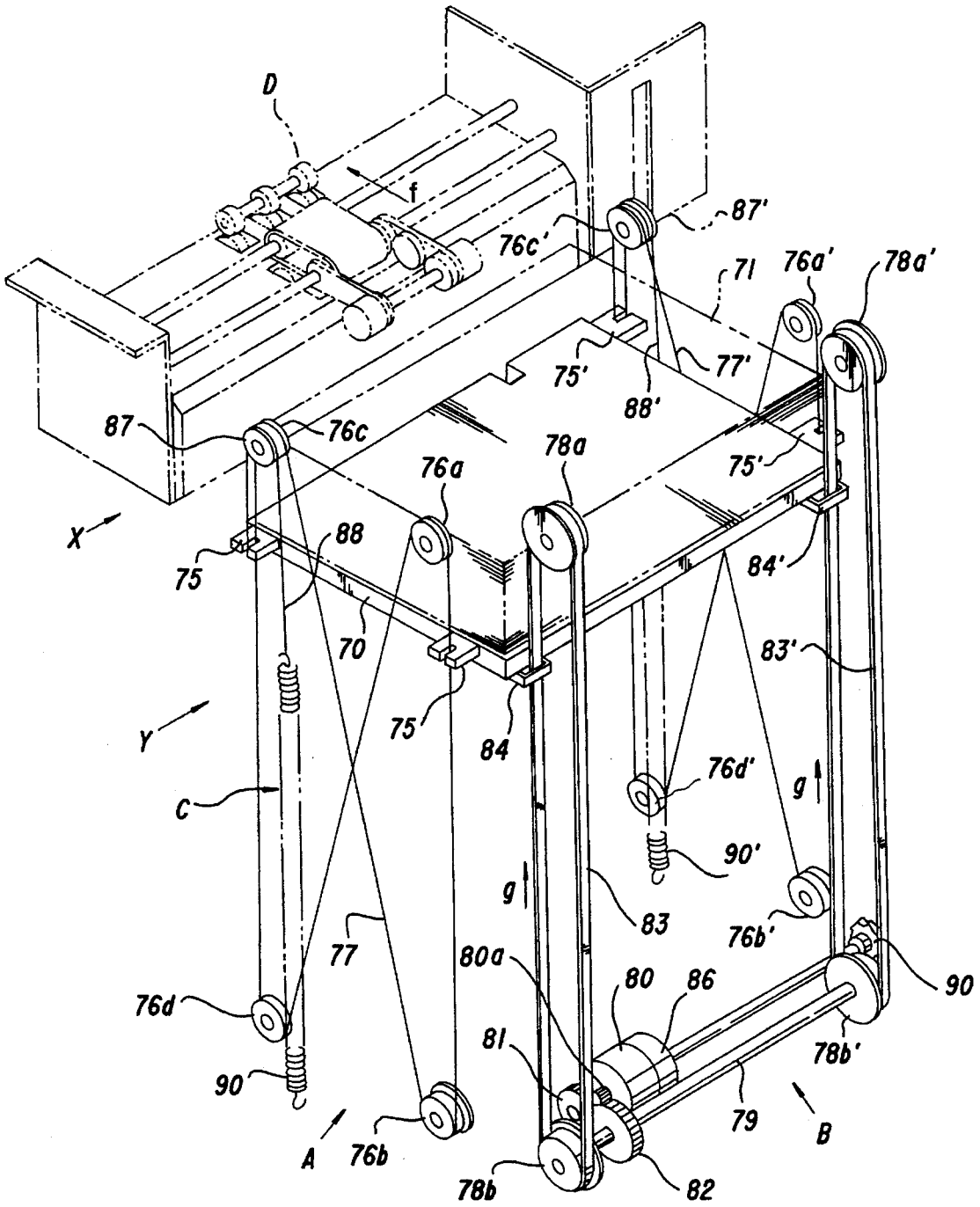

Next, reference is made to FIGS. 12 and 13, for describing a second embodiment where the paper accumulator unit of the invention is applied to a hopper 72.

In this embodiment, a table 70 is provided with the following mechanisms.

(i) Support mechanism A for supporting the table 70 in such a way that the table 70 is lifted or lowered, being kept in a horizontal condition.

(ii) Paper feed level holding mechanism B for lifting the table 70 such that the top of discrete paper sheets 71 stacked on the table 70 is kept at the paper feed level indicated by arrow X in FIG. 12, during paper feeding.

(iii) Paper replenishment level holding mechanism C for lowering the table 70 such that the top of the table 70 is kept at the paper replenishment level indicated by arrow Y in cases where no paper sheets are stacked on the table 70 and such that the top of the paper sheets 71 on the table 70 is kept at the paper replenishment level Y in cases where the paper sheets 71 are stacked on the table 70. With this mechanism C, the paper sheets 71 can be loaded at the paper replenishment level Y that is lower than the paper feed level X, for paper replenishment.

There is provided a feeding mechanism D at the position where the paper sheets 71 are fed through the opening 73 of the paper hopper 72 in the feeding direction f. The feeding mechanism D sequentially picks up and feeds the paper sheets 71 stacked on the table 70 to the electrophotographic device, starting with the top sheet. A paper presence/absence detecting member (not shown) is provided for determining by detection whether the paper sheets 71 are stacked on the table 70. A paper feed level detecting member (not shown) which partially constitutes the paper feed level holding mechanism B is provided for determining by detection whether the top of the paper sheets 71 stacked on the table 70 is positioned at the paper feed level X.

The support mechanism A, paper feed level holding mechanism B and paper replenishment level holding mechanism C will be hereinafter described.

(1) Support mechanism A

Side walls 72*a*, 72*b*, which are located on the right and left when viewed in the feeding direction f of the paper sheets 71 stored in the paper hopper 72, are each provided with a pair of guide grooves 74 (74'). The guide grooves 74 (74') in pair are aligned along the feed direction f, each extending in a vertical direction. Loosely inserted within the guide grooves 74 (74') are projections 75 (75'). These projections 75 are projected from both sides (with respect to the feed direction f)of the table 70 loosely fitted in the paper hopper 72. On the respective outer faces of the side walls 72*a*, 72*b* of the paper hopper 72, two pairs of upper and lower pulleys 76*a* to 76*d* (76*a'* to 76*d'*) are fixedly attached, being aligned along the feed direction f of the paper sheets 71. An endless wire rope 77 (77') is wound around the two pairs of pulleys 76*a* to 76*d* (76*a'* to 76*d'*) in figure-of-eight in such a fashion that the upright portions of the wire rope 77 (77') are formed in the ascent/descent plain of the table 70. The table 70 is suspended in a horizontal condition, being fixed to the upright portions of the endless wire ropes 77, 77' with the help of the projections 75, 75' attached to the table 70.

With the above arrangement, the table 70 is supported so as to be lifted to the opening 73 or lowered therefrom, being kept in a horizontal condition.

(2) Paper feed level holding mechanism B

On the outer face of a rear wall 72*c* (with respect to the feed direction f) of the paper hopper 72, two pairs of upper and lower pulleys 78*a*, 78*b* and 78*a'*, 78*b'* are aligned in a direction perpendicular to the feed direction f. The upper pulleys 78*a*, 78*a'* are individually fixed to the rear wall 72*c* of the paper hopper 72, while the lower pulleys 78*b*, 78*b'* are coupled to each other with a common rotary shaft 79 which is journaled in the rear wall 72*c* of the paper hopper 72 so as to be rotatable in forward and reverse directions. Coaxially fixed to the rotary shaft 79 is a gear 82 which is in mesh with a gear 81 fixed to a rotary shaft 80*a* of a stepping motor 80, so that the forward or reverse rotation of the stepping motor 80 is transmitted to the pulleys 78*b*, 78*b'*. An endless rubber belt 83 is extended, being wound around the pair of upper and lower pulleys 78*a*, 78*b* while an endless rubber belt 83' is extended, being wound around the pair of upper and lower pulleys 78*a'*, 78*b'*. These endless rubber belts 83, 83' have engagement pieces 84, 84' projected therefrom, respectively. These engagement pieces 84, 84' are loosely inserted in a pair of guide grooves 85, 85' defined in the rear wall 72*c* of the paper hopper 72 so as to come in engagement with the underside of the table 70. The guide grooves 85, 85' are aligned in a direction perpendicular to the feed direction f and extend vertically. A known deenergization-type electromagnetic brake 86 is attached to the rotary shaft 80*a* of the stepping motor 80. The electromagnetic brake 86 brakes the rotation of the rotary shaft 80*a* of the stepping motor 80 when its electromagnetic coil is in a deenergized state. The gears 81, 82 constitute a reduction gear mechanism composed of spur gears.

For paper feeding, the stepping motor 80 forwardly rotates, allowing the endless rubber belts 83, 83' to travel in the forward direction g shown in FIG. 13, so that the engagement pieces 84, 84' attached to the endless rubber belts 83, 83' ascend to come in engagement with the underside of the table 70. The table 70 engaged with the engagement pieces 84, 84' are lifted until it is determined by the aforesaid paper feed level detecting member that the top of the paper sheets 71 stacked on the table 70 has reached the paper feed level X and the stepping motor 80 is stopped. Based on the determination by the paper feed level detecting member as to whether the top of the paper sheets 71 stacked on the table 70 is positioned at the paper feed level X with the paper sheet 71 being fed, the stepping motor 80 is forwardly rotated to lift the table 70 to maintain the top of the paper sheet 71 at the paper feed level X.

(3) Paper replenishment level holding mechanism C

Pulleys 87, 87' are disposed coaxially with the pulleys 76*c*, 76*c'* of the support mechanism A respectively, the upper pulleys 76*c*, 76*c'* being positioned on the feeding side on the outer faces of the side walls 72*a*, 72*b* of the paper hopper 72. Wound around the pulleys 87, 87' are wire ropes 88, 88'. One end of each wire rope 88 (88') is suspended to be fixed to the projection 75 (75') of the table 70, while the other end being suspended to be coupled to one end of a coil spring 90 (90') which is fixed to the bottom of a casing 89 at the other end. The spring rate of the coil springs 90, 90' is so determined as to apply a lifting force to the table 70 in such a way that the top of the table 70 is maintained at the paper replenishment level Y when no paper sheets are stacked on the table 70 and that the top of the paper sheets 71 is maintained at the paper replenishment level Y when the paper sheets 71 are stacked on the table 70.

For paper replenishment, the stepping motor 80 of the paper feed level holding mechanism B is reversely driven to allow the endless rubber belts 83, 83' to travel in a direction opposite the forward direction g shown in FIG. 13. This allows the engagement pieces 84, 84' to be lowered, being released from engagement with the table 70, with the result that the table 70 descends until the top of the table 70 reaches the paper replenishment level Y when no paper sheets are stacked on the table 70 or until the top of the paper sheets 71 reaches the paper replenishment level Y when the paper sheets 71 are stacked on the table 70. After paper sheets have been replenished and stacked on the table 70, the table 70 is lowered such that the top of the replenished paper sheets 71 is positioned at the paper replenishment level Y. Note that reference numeral 90 is a handle used for rotating the rotary shaft 80*a* of the stepping motor 80 by manual operation.

Other parts and functions are similar to those in the first embodiment described earlier and therefore no explanation will be made.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A paper accumulator unit comprising:

(a) a table which can be lifted and lowered, being kept in a horizontal condition and on which paper which has been discharged from above is continuously stacked and stored;

(b) a stepping motor for lifting and lowering the table with the driving torque of its rotary shaft; and (c) an electromagnetic brake coupled to the rotary shaft of the stepping motor, which brakes the rotation of the rotary shaft when the brake is in a deenergized state.

2. A paper accumulator unit comprising:

(a) a table which can be lifted and lowered, being kept in a horizontal condition and stores a stack of paper which is to be continuously sent out therefrom, starting with the top;

(b) a stepping motor for lifting and lowering the table with the driving torque of its rotary shaft; and (c) an electromagnetic brake coupled to the rotary shaft of the stepping motor, which brakes the rotation of the rotary shaft when the brake is in a deenergized state.

3. The paper accumulator unit as claimed in claim 1 or 2, wherein the driving torque of the rotary shaft of the stepping motor is transmitted through a reduction gear mechanism composed of spur gears, when lifting or lowering the table.

4. The paper accumulator unit as claimed in claim 1 or 2, wherein the electromagnetic brake is energized into a non-operated state, when the rotary shaft of the stepping motor is driven to rotate.

5. The paper accumulator unit as claimed in claim 1 or 2, wherein when the rotation of the rotary shaft of the stepping motor is stopped, energizing current for the steeping motor is reduced or made zero and the electromagnetic brake is brought into its deenergized state to perform brake action.

6. The paper accumulator unit as claimed in claim 1 or 2, wherein the rotation of the rotary shaft of the stepping motor is stopped and the electromagnetic brake is brought into its deenergized state, for lifting or lowering the table by manual operation.

7. The paper accumulator unit as claimed in claim 1 or 2, wherein for lifting the table by means of the rotation of the rotary shaft, the rotational speed of the rotary shaft is controlled to increase step-wise or non step-wise.

8. The paper accumulator unit as claimed in claim 1 or 2, wherein the paper is continuous paper which is stacked on the table, being folded according to fold lines formed thereon such that its front face and back face alternately face up.

9. The paper accumulator unit as claimed in claim 1 or 2, wherein the paper is discrete paper sheets to be stacked on the table.

10. The paper accumulator unit as claimed in claim 1, wherein the paper is continuous paper which is stacked on the table, being folded according to fold lines formed thereon such that its front face and back face alternately face up, wherein there is provided above the table a swing guide which swings about a predetermined swing angle to shake and guide the continuous paper such that the paper is stacked on the table, being sequentially folded according to the fold lines with its front and back faces alternately facing up; and wherein the table has a stopper which is disposed at either side thereof with respect to the swing directions of the swing guide and which projects upwardly from the top face of the table, and when the swing guide starts to shake the continuous paper, the swing guide is held at the side of the stopper so that the leading end of the continuous paper strikes against the stopper.

11. The paper accumulator unit as claimed in claim 10, further comprising a movable guide which is disposed on the other side of the table with respect to the swing directions of the swing guide, which includes at least a portion lying above the top face of the table, and which is movable along the swing directions of the swing guide.

12. The paper accumulator unit as claimed in claim 1, wherein the paper is continuous paper which is stacked on the table, being folded according to fold lines formed thereon such that its front face and back face alternately face up, wherein there is provided above the table a swing guide which swings about a predetermined swing angle to shake and guide the continuous paper such that the paper is stacked on the table, being sequentially folded according to the fold lines with the front and back faces alternately facing up;

wherein the table has a stopper which is disposed at either side thereof with respect to the swing directions of the swing guide and which projects upwardly from the top face of the table to prevent fold edges at one fold end of the continuous paper from jetting out; and wherein a movable guide is provided for preventing fold edges at the other fold end of the continuous paper from jetting out, which is disposed on the other side of the table with respect to the swing directions of the swing guide, which includes at least a portion lying above the top face of the table, and which is movable along the swing directions of the swing guide, and wherein when discharging the continuous paper by manual operation, the swing guide is held so as to discharge the continuous paper substantially perpendicularly to the table.

13. The paper accumulator unit as claimed in claim 1 or 2, further comprising a lower limit position detecting sensor for detecting the lower limit position of the table, wherein at least the electromagnetic brake is brought into its deenergized state, upon detection of the lower limit position by the lower limit position detecting sensor.

14. The paper accumulator unit as claimed in claim 13, wherein in addition to changing of the electromagnetic brake into its deenergized state, the rotation of the rotary shaft of the stepping motor is stopped.

15. The paper accumulator unit as claimed in claim 1 or 2, further comprising a lowering preventing mechanism that is arbitrarily set to prevent at least lowering of the table.

* * * * *